US008490309B2

(12) United States Patent
Zukowski

(10) Patent No.: US 8,490,309 B2
(45) Date of Patent: Jul. 23, 2013

(54) TWO-PIECE TRIGGER AND SPRING RETENTION SYSTEM

(75) Inventor: Gary Zukowski, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 374 days.

(21) Appl. No.: 13/074,824

(22) Filed: Mar. 29, 2011

(65) Prior Publication Data

US 2011/0232150 A1 Sep. 29, 2011

Related U.S. Application Data

(60) Provisional application No. 61/318,566, filed on Mar. 29, 2010.

(51) Int. Cl.
*F41A 19/00* (2006.01)

(52) U.S. Cl.
USPC ..... 42/69.01; 42/69.02; 42/42.03; 42/DIG. 1; 89/27.14; 89/147

(58) Field of Classification Search
USPC ..... 42/69.01, 69.02, 69.03, 20, 34, 42.03, 42/DIG. 1; 89/27.14, 147
See application file for complete search history.

(56) References Cited

U.S. PATENT DOCUMENTS

| | | | | |
|---|---|---|---|---|
| 6,158,424 | A * | 12/2000 | Kunimoto | 124/73 |
| 6,415,539 | B1 * | 7/2002 | Fuchs et al. | 42/70.07 |
| 6,494,194 | B2 * | 12/2002 | Shipachev et al. | 124/73 |
| 6,772,548 | B1 * | 8/2004 | Power | 42/69.03 |
| 7,234,261 | B2 * | 6/2007 | McGarry | 42/70.05 |
| 2009/0188145 | A1 * | 7/2009 | Fluhr et al. | 42/69.01 |

* cited by examiner

*Primary Examiner* — J. Woodrow Eldred
(74) *Attorney, Agent, or Firm* — Ballard Spahr LLP

(57) ABSTRACT

A trigger assembly for a firearm includes a trigger and a trigger spring. The trigger assembly is mounted and retained in a frame of the firearm and, more specifically, in an elongated recess defined by the frame. The frame further defines lateral annular grooves and retaining lips near an opening of the elongated recess. The trigger includes an upper trigger piece and a lower trigger piece that are connected to each other. The upper trigger piece is mounted to the lateral annular grooves and retained by the retaining lips. The lower trigger piece is configured to fit in the opening and protrude from the frame. The trigger assembly also includes a trigger spring, mounted in a spring recess defined in the upper trigger piece, that spring biases the trigger into a resting position by abutting and engaging a trigger bar of the firearm under a torsional compression.

16 Claims, 2 Drawing Sheets

TWO-PIECE TRIGGER AND SPRING RETENTION SYSTEM

CROSS REFERENCE TO RELATED APPLICATION

This application claims the benefit of U.S. Provisional Application No. 61/318,566, filed Mar. 29, 2010, entitled "TWO-PIECE TRIGGER AND SPRING RETENTION SYSTEM", the aforementioned application being hereby incorporated by reference in its entirety.

FIELD OF THE INVENTION

The invention relates to a trigger for a firearm. In particular, the present invention relates to a two-piece trigger and spring retention system for a firearm.

BACKGROUND OF THE INVENTION

Firearms known in the art are provided with a trigger assembly including a trigger for actuating a firing mechanism of the firearm. The trigger is, in general, pivotally mounted along a bottom surface of a frame of the firearm, near a grip of the firearm. For instance, the firing mechanism of the firearm is actuated when the trigger is squeezed toward the grip and into a firing position. In order to return the trigger to a resting position (i.e., away from the grip), the trigger assembly often includes a spring to provide the requisite biasing action.

The trigger is traditionally of unitary construction, although two-piece triggers are known. However, regardless of design, during service of a known trigger, the entire trigger must be disconnected from each abutting interconnected element, removed from the frame, substituted and then re-installed. This process, as well as the installation process in general, is complex and time consuming.

There is a need for a trigger that can be installed and serviced more readily, for instance, with less impact on the interconnections of the trigger to the abutting elements.

Traditionally, the trigger is mounted to the frame via a mounting mechanism that is received by opposing lateral recesses in the frame. For example, the mounting mechanism is a pin that is inserted through a bore in the trigger or, alternatively, a pair of lateral protrusions integral with the trigger.

Traditionally, the spring is a coil spring that is positioned substantially transversely between connections, such as cross pins, formed on the trigger and the grip, respectively. The spring biases the trigger into a resting position so that, when the trigger is moved toward the firing position, the spring compresses linearly. When the trigger is released, the stored energy in the spring returns the trigger to the resting position.

The spring is not involved in mounting the trigger to the frame. Instead, the spring provided as a separate mechanism entirely. More specifically, the spring is disposed externally with respect to the trigger and must be separately attached to retain the spring in the frame. This separation of functional units—the spring from the trigger—results in complexity, additional assembly time and an additional amount of space required to house the trigger assembly within the frame.

There is a need for a trigger assembly that reduces complexity of the trigger assembly and the amount of space required to house the trigger assembly within the frame. There is a further need for a trigger assembly that simplifies and facilitates the mounting and retention of the trigger and the spring to the frame.

Traditionally, trigger assemblies also include a trigger bar, which functionally connects the trigger to the firing mechanism. The trigger bar is, in general, designed to be a separate element that does not impact or connect to the trigger except as functionally required (i.e., to translate the actuation of the trigger to the firing mechanism). This separation of functional units—the trigger bar and the firing mechanism from the trigger and the trigger mounting means—results in complexity and additional assembly time. For instance, during assembly, the trigger bar is connected to the trigger in a process step that is separate from the step of mounting the trigger assembly to the frame.

There is a need for a trigger assembly that integrates the trigger bar into the process of and mechanism for mounting and retaining the trigger assembly including.

The object of the present invention is, therefore, to provide an improved trigger assembly, which, among other desirable attributes, significantly reduces or overcomes the above-mentioned deficiencies of prior trigger assemblies.

SUMMARY OF THE INVENTION

Accordingly, the present invention provides a trigger assembly for a firearm, the trigger assembly including a multiple piece trigger defining a spring recess and a trigger spring mounted in the spring recess, the trigger and the trigger spring forming a mounting mechanism for connecting the trigger to a frame of the firearm.

In an aspect of the present invention a trigger is provided that includes an upper trigger piece functionally connected to a frame. In another aspect of the present invention the trigger also includes a lower trigger piece connected to the upper trigger piece for actuation by a user.

It is an object of the present invention to provide a lower trigger piece that can be installed and serviced readily and, more specifically, with reduced impact on the functional connections of the upper trigger piece to the frame.

In an aspect of the present invention an upper trigger piece and a lower trigger piece are provided that connect to one another via a spline connection. In another aspect of the present invention a press-fit engagement is provided between the upper trigger piece and the lower trigger piece using tapers of the spline connection.

In an aspect of the present invention a trigger assembly is provided that has a trigger spring for biasing the trigger into a resting position. In another aspect of the present invention a trigger spring is provided that is integrated into a mounting mechanism and, more specifically, that dampens the connection of the trigger to the frame.

In another aspect of the present invention a trigger assembly is provided having a trigger bar for connecting a trigger to a firing mechanism of the firearm. It is an object of the present invention to provide a trigger bar that is integrated into a mounting mechanism for connecting the trigger assembly to a frame of the firearm.

In an aspect of the present invention a trigger spring is provided that is connected between the trigger and the trigger bar. It is an object of the present invention to provide a trigger spring having ends that do not connect to or otherwise abut the frame.

In an aspect of the present invention, an upper trigger piece and a trigger are provided. The upper trigger piece defines a spring recess and the trigger spring has a first end configured to be inserted into the spring recess and, more specifically, to press fit to the spring recess. In another aspect of the present invention a trigger spring is provided having a first end that is a detent spring for engaging the spring recess. In another aspect of the present invention a trigger spring is provided having a first end that is torsionally fixed with respect to the trigger.

In an aspect of the present invention a trigger bar and a trigger spring are provided, the trigger spring having a second end configured to abut the trigger bar. In another aspect of the present invention the second end of the trigger spring is configured to abut the trigger bar when the trigger spring is torsionally compressed for biasing a trigger relative to the trigger bar.

In general, it is an object of the present invention to provide a trigger assembly that is less complex and more readily installed and serviced than trigger assemblies known in the art.

These and other features of the present invention are described with reference to the drawings of preferred embodiments of the trigger assembly for the firearm. The illustrated embodiments of the trigger assembly of the present invention are intended to illustrate, but not limit, the invention.

DETAILED DESCRIPTION OF THE PREFERRED EMBODIMENTS

Figure 1:
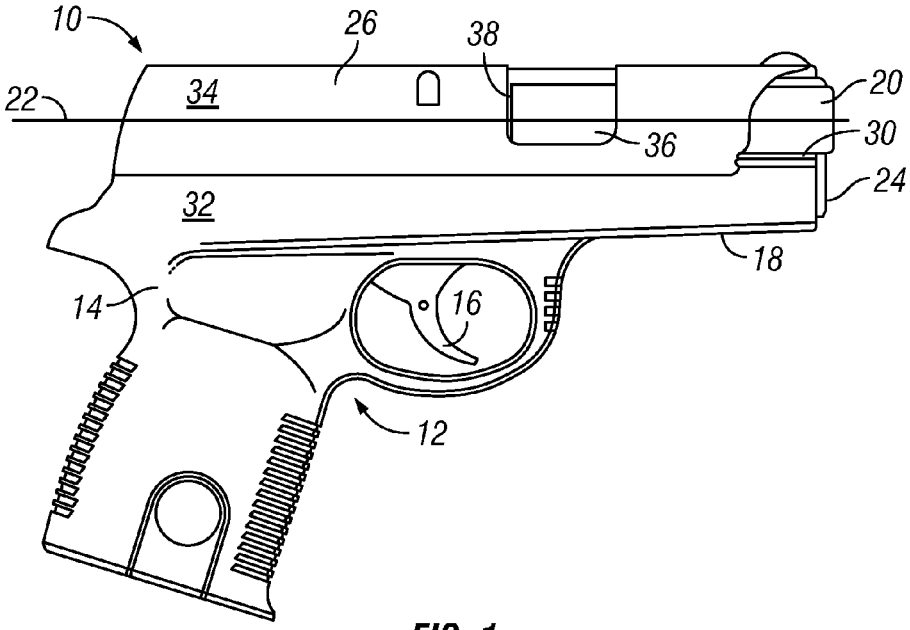
FIG. 1 (Prior Art)
FIGS. 1-2 illustrate a firearm according to the prior art.
Figure 2:
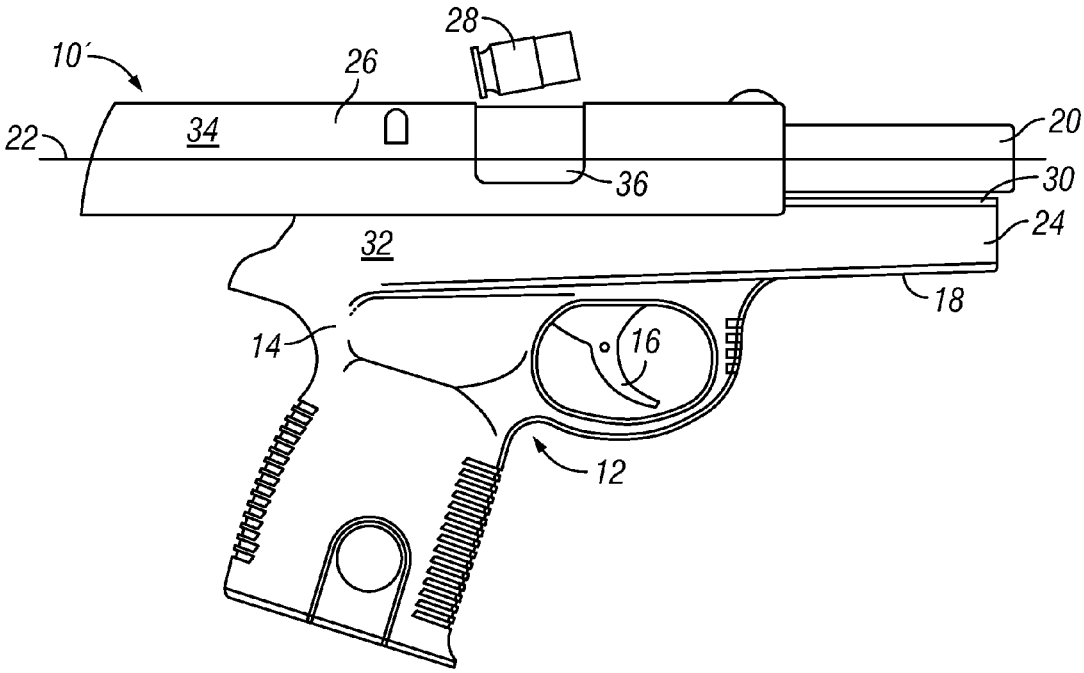
FIG. 2 (Prior Art)

Referring to FIGS. 1 and 2, one example of a firearm, handgun or pistol (hereinafter referred to as "firearm 10") that is known in the art is shown. The firearm 12 includes a frame 10 having a grip 14 for holding the firearm 10, a trigger 16 for actuating a firing mechanism, the trigger 16 being disposed on a bottom surface 18 of the frame 12, a barrel 20 that defines a firing axis 22 of the firearm 10 and a lower muzzle portion 24 that underlies the barrel 20. A slide 26 is mounted to the frame 12 and houses the barrel 20 at a front end thereof. The barrel 20 is cooperatively linked with the slide 26. A rearward end of the barrel 20 is adapted for receiving an ammunition cartridge 28.

The slide 26 is fitted to oppositely positioned rails 30 on each side 32 of the frame 12 to effect the reciprocal movement of the slide 26 along the longitudinal firing axis 22. The rails 30 extend along the underside of the slide 26 in the longitudinal direction and are cooperative with the frame 12 to allow the cycling of the slide 26 between forward (battery) and rearward (retired) positions. The slide 26, which is defined by a slide frame 34, further includes a breech face 36 and an extractor port 38. The breech face 36 is engageable with the rearward end of the barrel 20 to form a firing chamber when the slide 26 is disposed forwardly on the frame 12 as shown in FIG. 1. An ejection mechanism provides for the ejection of an ammunition cartridge 26 casing upon firing the firearm 10 or manually cycling the slide 26.

The cooperation of the frame 12, the trigger 16, the barrel 20, the slide 26, and the firing mechanism during the loading, firing, and ejecting of an ammunition cartridge 28 or a cartridge casing can be understood by referring to U.S. Pat. No. 5,086,579 entitled "DECOCKING MECHANISM FOR A SEMI-AUTOMATIC FIREARM"; U.S. Pat. No. 5,386,659 entitled "FIRE CONTROL MECHANISM FOR SEMI-AUTOMATIC FIREARMS"; and U.S. Pat. No. 5,406,731 entitled "HANDGUN OF IMPROVED ERGONOMIC CONSTRUCTION," all of which are owned by the assignee of the present invention and are incorporated by reference herein. U.S. Pat. No. 5,014,456 entitled "CARTRIDGE MAGAZINE FOR SEMI-AUTOMATIC FIREARMS"; U.S. Pat. No. 5,060,555 entitled "SLIDE DECELERATOR FOR A FIREARM"; U.S. Pat. No. 5,492,689 entitled "RECOIL MECHANISM FOR HANDGUNS"; U.S. Pat. No. 5,402,593 entitled "SAFETY TRIGGER FOR A FIREARM"; U.S. Pat. No. 5,437,118 entitled "FRAME PLUG FOR SEMI-AUTOMATIC HANDGUNS"; U.S. Pat. No. 5,438,783 entitled "BUTT PLATE ASSEMBLY FOR HANDGUN MAGAZINES"; U.S. Pat. No. 5,438,784 entitled "MAGAZINE SAFETY"; U.S. Pat. No. 5,566,487 entitled "INTEGRAL BUTT PLATE WITH LATCH AND CATCH MECHANISMS FOR PISTOL MAGAZINE"; U.S. Pat. No. 5,615,505 entitled "MAGAZINE CARTRIDGE GUIDE"; and U.S. Pat. No. 5,717,156 entitled "SEMI-AUTOMATIC PISTOL", are also owned by the assignee of the present invention and are incorporated by reference herein.

Figure 3:
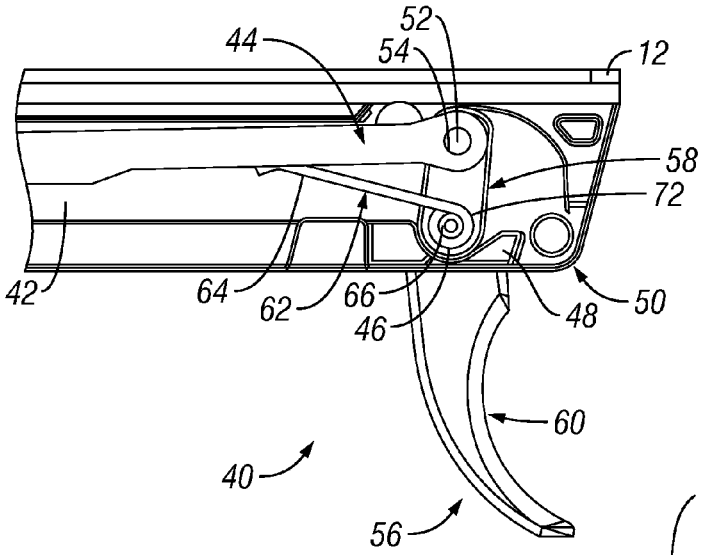
FIG. 3 illustrates a side view of a firearm having a trigger assembly, with a housing of the firearm removed, according to one embodiment of the present invention.

Referring to FIG. 3, a trigger assembly 40 according to the present invention is shown mounted to the frame 12 of the firearm 10. In particular, the frame 12 defines an elongated recess 42 for housing a trigger bar 44 and part of the trigger assembly 40. Toward the muzzle end of the firearm 10, the frame 12 further defines a pair of lateral annular grooves 46, a pair of retaining lips 48 and an opening 50, respectively, that are in communication with the elongated recess 42.

A first end of the trigger bar 44 is connected with the firing mechanism (not shown for clarity) of the firearm 10. A second end of the trigger bar 44 is connected to the trigger assembly 40 via a pin 52, formed on the trigger assembly 40, and a bore 54, defined in the trigger bar 44, connection. The pin 52 and bore 54 connection is configured such that the insertion of the trigger assembly 40 into the opening 50 of the frame 12 causes the pin 52 and bore 54 to come into contact and slip fit into engagement with one another.

The trigger assembly 40 includes a trigger 56 having a multiple piece design, including an upper trigger piece 58 and a lower trigger piece 60, and a trigger spring 62. The upper trigger piece 58 is connected to the trigger bar 44 and mounted to the lateral annular grooves 46. The retaining lips 48, which are disposed on each lateral side of the opening 50, abut the upper trigger piece 58 when mounted and retain the upper trigger piece 58 in the lateral annular grooves 46. To remove the upper trigger piece 58, for repair or service, rotate the upper trigger piece 58 frontward (i.e., away from a firing position), over the retaining lips 48 and through the opening 50. The upper trigger piece 58 is readily accessible once the upper trigger piece 58 clears the threshold of the retaining lips 48.

The trigger spring 62 of the trigger assembly 40 includes a spring arm 64 and a coil base 66, which is housed in a spring recess 68 defined in the lower trigger piece 60. The spring arm 64 extends from the upper trigger piece 58 and slidably engages the trigger bar 44.

Figure 4:
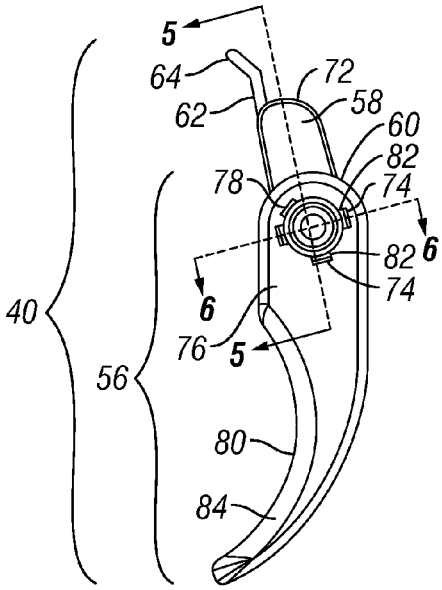
FIG. 4 illustrates a side view of a trigger, including an upper trigger piece and a lower trigger piece, according to the embodiment of FIG. 3.
Figure 5:
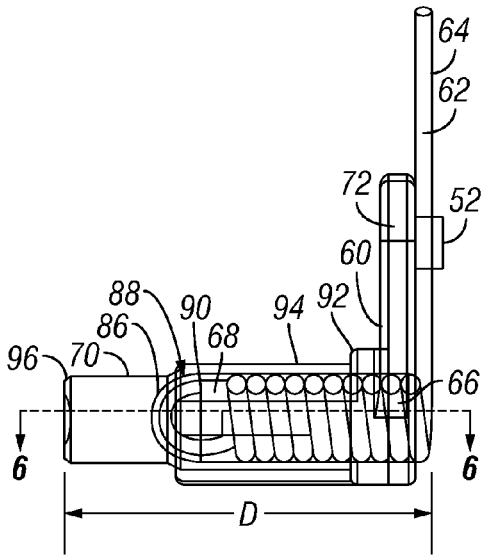
FIG. 5 illustrates a cross section of an upper trigger piece and a trigger spring, along line 5-5, according to the embodiment of FIG. 3.
Figure 6:
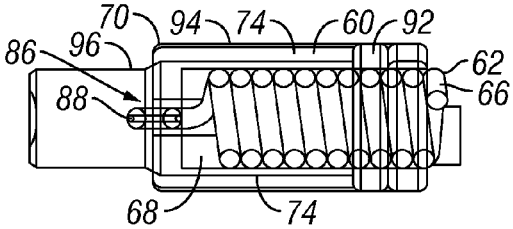
FIG. 6 illustrates a cross section of an upper trigger piece and a trigger spring, along line 6-6, according to the embodiment of FIG. 3.

Referring to FIGS. 4-6, the upper trigger piece 58 includes a cylindrical portion 70 and an eccentric portion 72 that extends from an axial end of the cylindrical portion 70. The eccentric portion 72 of the upper trigger piece 58 has the pin 52 formed therewith and defines an opening of the spring recess 68. The spring recess 68 extends through the length of the cylindrical portion 70 of the upper trigger piece 58. The cylindrical portion 70 of the upper trigger piece 58 is substantially annular and has substantially rectangular protrusions 74 formed about the circumference thereof. As shown, three substantially rectangular protrusions 74 are formed at 90 degree intervals about the circumference of the cylindrical portion 70 of the upper trigger piece 58.

The lower trigger piece 60, which forms the visible portion of the trigger 16 in the fully assembled firearm 10 (see FIGS. 1-2), is connected to the upper trigger piece 58. In particular, the lower trigger piece 60 has a base portion 76 that defines a recess 78 and a crescent shaped finger portion 80 along a distal end therefrom. The recess 78 is fitted to be mounted to the cylindrical portion 70 of the upper trigger piece 58. For instance, the recess 78 of the lower trigger piece 60 is substantially annular, but also includes substantially rectangular indentations 82 about the circumference thereof. As shown, three rectangular indentations 82 are provided at 90 degree intervals about the recess 78 of the lower trigger piece 60. The rectangular indentations 82 of the lower trigger piece 60 correspond to the rectangular protrusions 74 of the upper trigger piece and together form a spline connection between the lower trigger piece 60 and the upper trigger piece 58. The spline connection rotationally fixes and ensures the proper alignment of the lower trigger piece 60 relative to the upper trigger piece 58, and visa verse. The spline connection transmits the torque from the lower trigger piece 60 to the upper trigger piece 58.

The finger portion 80 of the lower trigger piece 60 is configured to be manually actuated by a user. For instance, the finger portion 80 of the lower trigger piece 60 can be provided with contoured edges 84.

Referring to FIGS. 5-6, the cylindrical portion 70 of the upper trigger piece 58 is hollow and defines the spring recess 68 and a spring pocket 86 at a remote end thereof. The spring recess 68 of the upper trigger piece 58 houses the coil base 66 of the trigger spring 62 and the spring pocket 86 is fitted to receive a remote end 88 of the trigger spring 62. When assembled, the spring pocket 86 rotationally fixes the position of the remote end 88 of the trigger spring 62 with respect to the upper trigger piece 58. As a result, a torsial compression can be applied to the trigger spring 62 by rotating the spring arm 64 relative to the upper trigger piece 58.

In the unactuated position (see FIG. 4), the spring arm 64 extends from the upper trigger piece 58 substantially parallel to the length of the trigger 56. In this position, the trigger spring 62 is not compressed. During installation, the trigger spring 62 starts in the unactuated position and is inserted into the opening 50 and along the trigger bar 44 in the elongated recess 42. The trigger spring 62 biases the trigger bar 44 against the upper surface of the elongated recess 42 of the frame 12 for facilitating the alignment of the pin 52 and bore 54 connection.

In the resting position (see FIG. 3), the spring arm 64 is bent at substantially 90 degrees to the length of the trigger 56, which causes the coil base 66, in particular, to compress torsionally. In this position, the torsional compression of the trigger spring 62 biases the trigger 56 toward the installation position.

In the firing position, the spring arm 64 is further bent at substantially 180 degrees to the length of the trigger 56, which causes the coil base 66 to further compress torsionally. In this position, the torsional compression of the trigger spring 62 biases the trigger 56 further toward the installation position. However, due to the length and configuration of the trigger bar 44, the retaining lips 48 and other structural elements, the trigger 56 comes to rest in the resting position.

Further, the remote end 88 of the trigger spring 62 has a curved shape and the cylindrical portion 70 of the upper trigger piece 58 defines a retaining ledge 90. The remote end 88 of the trigger spring 62 and the retaining ledge 90 are configured to be engaged with one another. The remote end 88 may be engaged with the retaining ledge 90 by being press fit into the retaining ledge. As a result, the trigger spring 62 is retained within the upper trigger piece 58 unless and until the trigger spring 62 is forcibly removed therefrom, which facilitates handling during installation and service.

Referring to FIG. 5, the pin 52 of the upper trigger piece 58 extends beyond a width D of the upper trigger piece 58 and the trigger spring 62 to create a snug fit between the axial end of the pin 52 and the opposing end of the upper trigger piece 58 and the lateral walls of the elongated recess 42 of the frame 12.

The cylindrical portion 70 of the upper trigger piece 58 includes three concentric cylindrical subportions 92, 94, 96. Abutting the eccentric portion 72 of the upper trigger piece 58 is a large cylindrical subportion 92, which is configured to be inserted into one of the lateral annular grooves 46 of the frame 12. Abutting the large cylindrical subportion 92 is a medium cylindrical subportion 94, which is fitted to the recess 78 of the lower trigger piece 60. As seen in FIG. 6, the medium cylindrical subportion 94 includes the rectangular protrusions 74, which run axially along the length of the medium cylindrical subportion 94. The width of the medium cylindrical subportion 94 corresponds to the lateral width of the lower trigger piece 60 and the opening 50 between the lateral annular grooves 46 of the frame 12, into which the lower trigger piece 60 is rotatably mounted. Abutting the medium cylindrical subportion 94 is a small cylindrical subportion 96, which is configured to be inserted into the lateral annular grooves 46 of the frame 12.

It should be appreciated that during installation or service, the upper trigger piece 58 can be passed through the opening 50 of the frame 12 such that the trigger spring 62 can be removed and replaced without disrupting the relationship of the upper trigger piece 58 to the trigger bar 44 and the frame 12. Even more so, the trigger assembly 40 is not retained by pins, screws, or secondary fasteners that would need to be removed to service the trigger assembly.

It should be appreciated that the present invention is applicable for any firearm having any firing mechanism. For instance, the present invention also applicable to rifles and other trigger actuated firearms and is particularly suited for use with firearms having non-metallic components, as disclosed in U.S. patent application Ser. No. 12/648,902 entitled "FIREARM HAVING NONMETALLIC COMPONENTS"; U.S. patent application Ser. No. 12/650,038 entitled "AN AUTOMATIC FIRING PIN BLOCK SAFETY FOR A FIREARM"; U.S. patent application Ser. No. 12/650,124 entitled "A MANUAL SLIDE AND HAMMER LOCK SAFETY FOR A FIREARM"; U.S. patent application Ser. No. 12/650,217 entitled "A CONFIGURABLE SIGHT FOR A FIREARM"; U.S. Provisional Patent Application No. 61/169,356 entitled "FIREARM HAVING NONMETALLIC COMPONENTS AND AN AMBIDEXTROUS CYLINDER RELEASE LEVER"; U.S. Provisional Patent Application No. 61/169,359 entitled "FIREARM HAVING NONMETALLIC COMPONENTS AND AN EXTRACTOR YOKE LOCKUP"; and U.S. Provisional Patent Application No. 61/318,557 entitled "INTEGRAL, FRAME-MOUNTED LASER AIMING DEVICE", which are owned by the assignee of the present invention and are incorporated by reference herein.

It should be understood that the foregoing description is only illustrative of the invention. Various alternatives and modifications can be devised by those skilled in the art without departing from the broader aspects of the present invention.

For instance, according to another embodiment of the present invention, the finger portion of the lower trigger piece can be provided with texturing or ridges to promote traction by a user.

According to another embodiment of the present invention, the pin and bore connection of the trigger and trigger bar are reversed such that the pin is disposed on the trigger bar and the bore is defined by the trigger.

According to another embodiment of the present invention, a retaining mechanism is mounted to the opening of the frame to block the trigger assembly from exiting the opening unless and until the retaining mechanism is disabled.

According to another embodiment of the present invention, the remote end of the spring may be held in place against the retaining ledge by axial compression of the coil base. The axial compression of the base may be due to a snug fit between the opposing end of the trigger pieces and the lateral walls of the frame.

What is claimed is:

1. A trigger assembly for a firearm having a frame and a firing mechanism, the trigger assembly comprising:

an upper trigger piece having a cylindrical portion and defining a spring recess extending at least partially through the cylindrical portion;

a lower trigger piece mounted about the cylindrical portion, the lower trigger piece extending downward from the upper trigger piece for actuation by a user; and a trigger spring mounted within the spring recess and extending therefrom.

2. The trigger assembly of claim 1, wherein the lower trigger piece is mounted to the upper trigger piece by a spline connection for transferring torque between the upper trigger piece and the lower trigger piece.

3. The trigger assembly of claim 1, further comprising a trigger bar for connecting the upper trigger piece to the firing mechanism of the firearm, the trigger bar being connected with the frame of the firearm and rotatably connected to the upper trigger piece to allow the upper trigger piece to rotate with respect to the trigger bar.

4. The trigger assembly of claim 1, wherein the trigger spring is in immediate contact with the trigger bar to provide a biasing force to the upper trigger piece.

5. The trigger assembly of claim 1, wherein the trigger spring includes a first end and a second end that are translationally and rotationally free with respect to the frame of the firearm.

6. The trigger assembly of claim 5, wherein the first end of the trigger spring being fixed with respect to the upper trigger piece by the retaining ledge.

7. The trigger assembly of claim 1, wherein the cylindrical portion of the upper trigger piece defines a retaining ledge adjacent to the spring recess, the trigger spring has a first end dimensioned to be inserted into the retaining ledge.

8. A firearm assembly comprising:

a frame including a grip and a firing mechanism located within the frame, the frame having a pair of annular grooves and a pair of retaining lips and defining an opening in a bottom of the frame forward of the grip and the retaining lips; and a trigger assembly including:

an upper trigger piece having a cylindrical portion and defining a spring recess extending at least partially through the cylindrical portion;

a trigger bar connected to the firing mechanism and the frame, the trigger bar being removably and rotationally connected with the upper trigger piece;

a lower trigger piece mounted about the cylindrical portion, the lower trigger piece extending downward from the upper trigger piece for actuation by a user; and a trigger spring mounted within the spring recess and extending therefrom to contact the trigger bar, wherein the cylindrical portion and the trigger spring abuts against the retaining lips of the frame to hold the trigger assembly within the frame.

9. The firearm assembly of claim 8, wherein the lower trigger piece is mounted to the upper trigger piece by a spline connection that includes rectangular protrusions extending from the cylindrical portion of the upper trigger piece and recesses sized and shaped in the lower trigger piece for transferring torque between the upper trigger piece and the lower trigger piece.

10. The firearm assembly of claim 8, wherein a first end of the trigger spring is in immediate contact with the trigger bar and a second end of the trigger spring is fixed within the spring recess of the upper trigger piece to provide a biasing force to the upper trigger piece.

11. The firearm assembly of claim 8, wherein the trigger spring includes a first end and a second end that are translationally and rotationally free with respect to the frame of the firearm.

12. The firearm assembly of claim 8, wherein the cylindrical portion of the upper trigger piece defines a retaining ledge adjacent to the spring recess, the trigger spring has a first end shaped and dimensioned to retained against the retaining ledge.

13. A method for removal of a trigger assembly from a firearm, the method comprising the steps of:

providing a firearm including a frame with a grip and a firing mechanism located within the frame, the frame having a pair of annular grooves and a pair of retaining lips, the frame defining an opening in a bottom of the frame forward of the grip and the retaining lips;

providing a trigger assembly including:

an upper trigger piece having a cylindrical portion and defining a spring recess extending at least partially through the cylindrical portion;

a trigger bar connected to the firing mechanism and the frame, the trigger bar being removably and rotationally connected with the upper trigger piece;

a lower trigger piece mounted about the cylindrical portion, the lower trigger piece extending downward from the upper trigger piece for actuation by a user; and a trigger spring mounted within the spring recess and extending therefrom to contact the trigger bar; wherein the cylindrical portion and the trigger spring abuts against the retaining lips of the frame to hold the trigger assembly within the frame;

providing an upward force to the lower trigger piece to dislodge the upper trigger piece and the trigger spring from a resting place against the pair of retaining lips;

moving the upper trigger piece forward through the opening in the frame;

unconnecting the upper trigger piece from the trigger bar; and removing the lower trigger piece, the upper trigger piece, and the trigger spring from the firearm.

14. The method of claim 13, further comprising the steps of removing and replacing the trigger spring from within the spring recess of the upper trigger piece.

15. The method of claim 14 further comprising, the steps of:

inserting the upper and lower trigger pieces and spring into the opening;

connecting the upper trigger piece with the trigger bar; and placing the cylindrical portion of the upper trigger piece along one of the pair of the retaining lips.

16. The method of claim 14, further comprising the step of biasing the trigger spring against the trigger bar to provide a biasing force to the upper trigger piece.

* * * * *